US010060620B2

(12) United States Patent
Ricci et al.

(10) Patent No.: US 10,060,620 B2
(45) Date of Patent: Aug. 28, 2018

(54) BURNER

(71) Applicant: Fives Pillard, Marseilles (FR)

(72) Inventors: Louis Ricci, Roquefort la Bedoule (FR); Gaël Le Piver, Marseilles (FR)

(73) Assignee: FIVES PILLARD, Marseilles (FR)

( * ) Notice: Subject to any disclaimer, the term of this patent is extended or adjusted under 35 U.S.C. 154(b) by 426 days.

(21) Appl. No.: 14/439,837

(22) PCT Filed: Nov. 28, 2013

(86) PCT No.: PCT/EP2013/075012
§ 371 (c)(1),
(2) Date: Apr. 30, 2015

(87) PCT Pub. No.: WO2014/086660
PCT Pub. Date: Jun. 12, 2014

(65) Prior Publication Data

US 2015/0276214 A1 Oct. 1, 2015

(30) Foreign Application Priority Data

Dec. 4, 2012 (FR) ..... 12 61626

(51) Int. Cl.
*F23D 1/00* (2006.01)
*F23D 1/02* (2006.01)

(52) U.S. Cl.
CPC ..... *F23D 1/005* (2013.01); *F23D 1/02* (2013.01); *F23C 2201/20* (2013.01); *F23C 2900/06043* (2013.01); *F23D 2900/01001* (2013.01)

(58) Field of Classification Search
CPC ... F23D 1/00; F23D 1/005; F23D 1/02; F23C 2201/20; F23C 2201/00; F23C 2900/07021; F23C 2900/01001; F23C 2900/14021; F23C 2900/00
USPC .... 110/104, 104 B, 260, 261, 262, 263, 264, 110/265, 347, 348
See application file for complete search history.

(56) References Cited

U.S. PATENT DOCUMENTS 4,611,543 A 9/1986 Collette
4,988,286 A * 1/1991 Hersh ..... F23D 1/00 239/434
5,090,339 A 2/1992 Okiura et al.
(Continued)

FOREIGN PATENT DOCUMENTS

FR 2 773 388 7/1999

OTHER PUBLICATIONS

PCT/EP2013/075012 International Search Report dated Jan. 23, 2014 (6 pages including English translation).

*Primary Examiner* — David J Laux
(74) *Attorney, Agent, or Firm* — Brinks Gilson & Lione; John C. Freeman

(57) ABSTRACT

A burner is described that includes a main longitudinal pipe into which there flows primary transport air loaded with solid particles of a pulverulent fuel, a longitudinal tube arranged inside and concentric to the main pipe, the longitudinal tube extending to the vicinity of a primary transport air outlet end of the main pipe and producing an outer longitudinal passage disposed around and concentric to an inner longitudinal passage, and means for distributing the different concentrations of solid particles in the primary transport air, in the outer longitudinal passage and in the inner longitudinal passage.

15 Claims, 2 Drawing Sheets

(56) References Cited

U.S. PATENT DOCUMENTS

| | | | | |
|---|---|---|---|---|
| 5,231,937 | A * | 8/1993 | Kobayashi | C04B 7/44<br>110/262 |
| 5,685,242 | A | 11/1997 | Narato et al. | |
| 6,116,171 | A | 9/2000 | Oota et al. | |

* cited by examiner

BURNER

This application claims priority to International Application No. PCT/EP2013/075012 filed Nov. 28, 2013 and to French Application No. 1261626 filed Dec. 4, 2012; the entire contents of each are incorporated herein by reference.

BACKGROUND

The present invention relates in general to the field of burners.

It applies in particular to burners that use a pulverulent fuel.

It relates for example but nonlimitingly to burners for rotating (or rotary) kilns, such as cement kilns or lime kilns.

There are two main types of such burners for rotary kilns, those referred to as "direct-fired" and those referred to as "indirect-fired".

In burners for rotary kilns referred to as "direct-fired", the pulverulent fuel is transported by the air, referred to as the primary transport air, that was used in the process of drying/grinding the pulverulent fuel, in a longitudinal main pipe.

The rest of the air, referred to as the secondary air, surrounds the main pipe and allows combustion. It is generally supplied in the form of the hot air resulting from the processes of cooling the material fired in the kiln, and which may be at a temperature of 500 to 1100° C.

The longitudinal main pipe may comprise a concentric internal pipe, equipped with pipes for conveying other fuels, it being possible for the other fuels to be a liquid such as oil, a gas, or a solid for igniting the primary transport air and the secondary air.

In burners for rotary kilns referred to as "indirect-fired", the air used for the process of drying/grinding the pulverulent fuel is filtered then discharged (or recirculated to elsewhere) without participating in the carriage of the pulverulent fuel to the burner. The pulverulent fuel is transported with a quantity of transport air which is far lower than in burners for rotary kilns what are referred to as "direct-fired".

The primary transport air with pulverulent fuel is transported to the burner in a secondary pipe concentric with and on the inside of a longitudinal main pipe.

The longitudinal main pipe may on the inside of the secondary pipe comprise a concentric internal pipe equipped with pipes for conveying other fuels, it being possible for the other fuels to be a liquid such as oil, a gas, or a solid for igniting the primary transport air and the secondary air.

A primary air without pulverulent fuel and which corresponds to fresh air, emerges at very high speed in pipes situated concentrically to the secondary pipe and to the main pipe, on the inside and/or on the outside of the main pipe.

The flows of primary air in these pipes may be axial or swirling (peripheral) on account of the presence of swirl-inducing means.

The rest of the air, referred to as secondary air, surrounds the longitudinal main pipe and allows combustion. It is generally supplied in the form of hot air originating from the processes of cooling the material fired in the kiln, and may be at a temperature of 500 to 1100° C.

The high speed and axial and/or swirling flows of the primary air ensure mixing between the primary transport air and the secondary air, in order to achieve combustion.

At its center, the longitudinal main pipe comprises an internal pipe equipped with: a flame stabilizer and fuel-conveying pipes, it being possible for the fuel to be a liquid such as oil, a gas, or a solid allowing the primary transport air and the secondary air to be ignited.

There is a need to achieve more rapid ignition of a "direct-fired" burner and an "indirect-fired" burner with a suitable concentration of the pulverulent fuel so as to achieve better volatilization of the pulverulent fuel and thereby make it easier to ignite. This rapid ignition of the pulverulent fuel has numerous advantages such as the reduction of oxides of nitrogen through the effect of the staging of the combustion, improved combustion of alternative fuels, and improved thermal profile within the kiln.

SUMMARY

In this context, it is an object of the present invention to propose a burner for a rotary kiln that allows such ignition to be achieved.

The burner for a rotary kiln comprises:

a longitudinal main pipe into the inlet of which primary transport air laden with solid particles of a pulverulent fuel circulates, a longitudinal tube arranged inside and concentric with the main pipe, the longitudinal tube extending as far as near to an outlet end at which the primary transport air leaves the burner and creating an exterior longitudinal passage arranged around and concentric with an interior longitudinal passage.

To that end, the burner is notable in that it comprises, upstream of the interior longitudinal tube with respect to the flow of the primary transport air along the main pipe, means of distributing different solid-particles concentrations of the primary transport air in the exterior longitudinal passage and in the interior longitudinal passage.

Advantageously, the distribution means are arranged in such a way as to create a higher solid-particles concentration in the primary transport air in the interior longitudinal passage than in the exterior longitudinal passage.

The distribution means comprise at least one solid-particles deflector arranged on the periphery of the main pipe to deflect the solid particles preferably toward the interior longitudinal passage.

The distribution means comprise several deflectors situated one after another in the main pipe, along the longitudinal axis of the main pipe, and arranged in such a way as to increase the solid-particles proportion in the interior longitudinal passage.

The deflectors comprise rings of different sizes, which are fixed in the burner concentrically, the smallest-diameter ring being situated downstream of the largest-diameter ring with respect to the flow of the primary transport air in the main pipe.

The burner comprises an interior pipe, arranged in and concentric with the interior longitudinal tube, the interior longitudinal passage is created between the interior pipe and the interior tube, and the exterior longitudinal passage is created between the interior longitudinal tube and the main pipe.

The rings have a frustoconical interior surface converging toward the interior pipe.

The interior pipe contains a flame stabilizer and fuel conveying pipes.

The burner has a mobile guide piece for guiding the flow of primary transport air toward the interior longitudinal passage.

A means for inducing swirl in the primary transport air is arranged in the exterior longitudinal passage.

The swirl-inducing means is fixed to the longitudinal tube, and the longitudinal tube and the interior pipe are able to move one with respect to the other.

It is thus possible to cause the same proportion of air flow rate to pass along the interior longitudinal passage and along the exterior longitudinal passage with more swirling air passing through the swirl-inducing means.

Also possible, as an alternative form of embodiment, is adjustment of the position of the longitudinal tube and of the interior pipe in order to change the proportion of air circulating through the interior and exterior longitudinal passages.

At the primary transport air outlet end, the interior pipe comprises a frustoconical exterior shape reducing the cross section of the interior longitudinal passage.

In the direct-fired embodiment of the rotary kiln, the primary transport air with pulverulent fuel represents 15% to 40% of the air for stoichiometric combustion.

In the indirect-fired embodiment of the rotary kiln, the primary transport air with pulverulent fuel represents 2% to 15% of the combustion air.

In this embodiment, the burner comprises at least one pipeline on the outside of and concentric with the main pipe and in which an axial flow of primary air circulates.

As an alternative form of embodiment, the burner comprises a first pipeline on the outside of and concentric with the main pipe which comprises a swirl means inducing swirl in the primary air, and a second pipeline on the outside of and concentric with the exterior first pipe.

The invention also relates to a method using the burner described hereinabove to create a combustion zone with a low concentration of pulverulent fuel and a central zone with a higher concentration.

This method comprises the steps in which:

a flow of primary air laden with solid particles of a pulverulent fuel is created at the inlet to a main pipe, the different solid-particles concentrations of the primary transport air are distributed in an exterior longitudinal passage of an interior tube that is also concentric with the main pipe and in an interior longitudinal passage of the interior tube.

BRIEF DESCRIPTION OF THE DRAWINGS

Other features and advantages of the invention will become clearly apparent from the description thereof given hereinafter by way of nonlimiting indication, with reference to the attached drawings in which.

DETAILED DESCRIPTION

Figure 1:
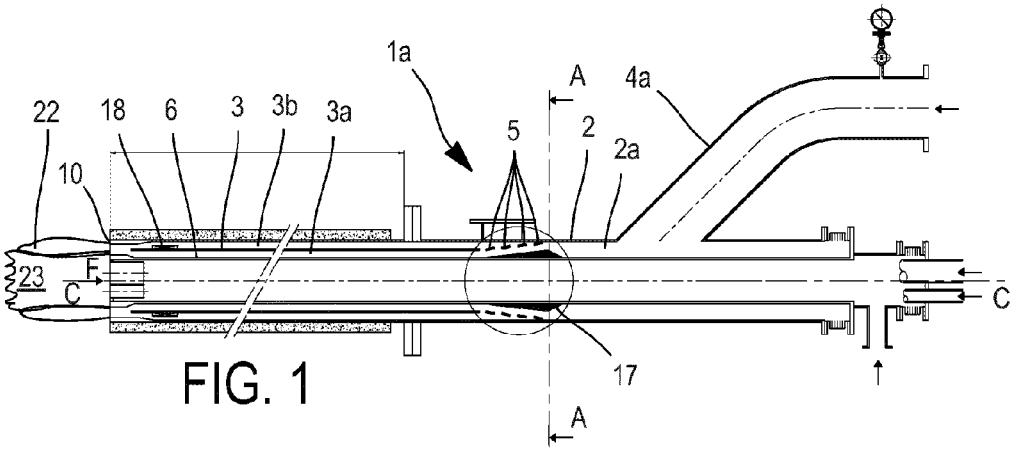
FIG. 1 is a view in longitudinal section of a burner for rotary kiln referred to as a "direct-fired" according to the invention.

The present description relates to a burner 1 for a rotary kiln comprising a cylindrical main pipe 2 transporting primary transport air laden with solid particles of a pulverulent fuel in an axial longitudinal part 2*a*.

The words "longitudinal" and "axial" qualify any element situated along a main axis C-C of the main pipe 2, the word "radial" any element situated along the radius of the main pipe 2 and the word "swirling" or "peripheral" any element situated along the perimeter of the main pipe 2.

The secondary air surrounds the main pipe 2 and is not depicted here.

According to the invention, arranged inside the main pipe 2 is a cylindrical concentric interior longitudinal tube 3 the downstream end of which extends as far as close to an outlet end at which the primary transport air leaves the nozzle of the burner 1.

The interior longitudinal tube 3 allows for the creation of a cylindrical exterior (to the tube) longitudinal passage 3*b* arranged around and concentric with a cylindrical interior (to the tube) longitudinal passage 3*a*.

As an alternative form of embodiment which has not been depicted, several longitudinal tubes may be arranged concentrically one inside the other in order to create more than two cylindrical longitudinal passages for the primary transport air.

The pulverulent fuel may for example be coal, petcoke, lignite, wood flour or any type of finely ground solid fuel.

The primary transport air laden with the solid particles comes from a transverse pipe 4*a*, 4*b* connected by a tapping to the main pipe 2.

For the sake of simplification and for the remainder of the description, the words "upstream" and "downstream" qualify the elements arranged in the direction of flow of the primary air from the transverse pipe 4*a*, 4*b* as far as the end of the nozzle.

The transverse pipe 4*a* has a larger diameter in the case of the first embodiment of the burner 1 for what is referred to as a "direct-fired" rotary kiln than for the transverse pipe 4*b* in the case of the second embodiment of the burner 1 for what is referred to as an "indirect-fired" rotary kiln, because of the higher flow rate of primary transport air that passes through it.

In the case of the burner 1*a* for a "direct-fired" rotary kiln, the primary transport air may represent 20% to 40% of the air for stoichiometric combustion and may be at a temperature for example of 50 to 80° C.

The primary transport air may contain between 0.3 and 1 kg of fuel per normal cubic meter of primary air.

In the case of the burner 1*b* for an "indirect-fired" rotary kiln, the primary transport air may represent 2% to 10% of the combustion air. It may contain a quantity of fuel of between 2 and 7 kg of per coal normal cubic meter of primary transport air. The primary air without pulverulent fuel and which corresponds to fresh air, emerges at very high speed, for example at speeds in excess of 200 m/s. This primary air without the air for transporting the pulverulent fuel may represent for example of the order of 5 to 20% of the air for stoichiometric combustion.

Figure 6:
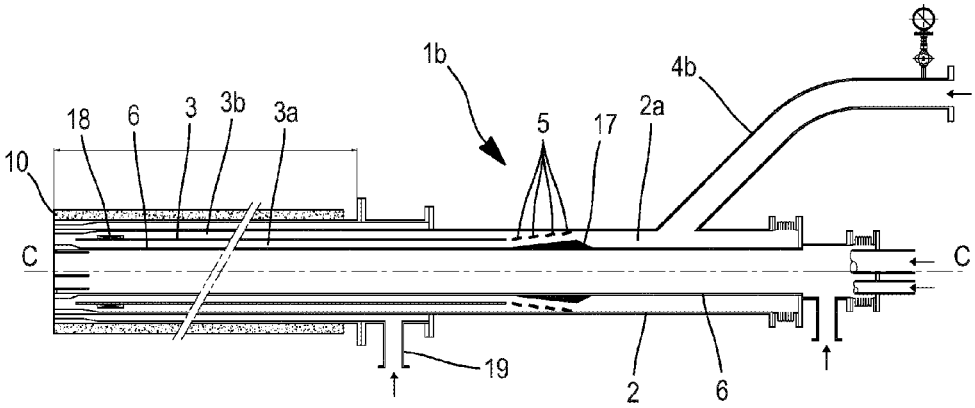
FIGS. 6 and 7 illustrate a burner for what is referred to as an "indirect-fired" rotary kiln.
Figure 7:
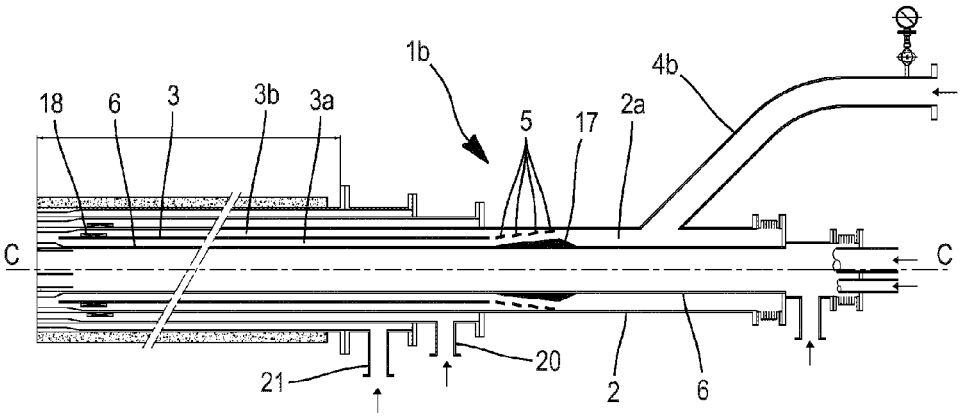

According to the invention and as described in FIGS. 1, 6 and 7, arranged in the longitudinal part 2*a* of the main pipe 2 upstream of the cylindrical interior longitudinal tube 3 are means for distributing the different solid-particles concentrations of the primary transport air in the exterior longitudinal passage 3*b* and in the interior longitudinal passage 3*a* (or between the exterior longitudinal passage 3*b* and the interior longitudinal passage 3*a*).

Here, the distribution means are arranged in such a way as to create a greater solid-particles concentration in the primary transport air in the interior longitudinal passage 3*a* and on the outside of and in front of the latter (zone 23), referred to as airflow A, than in the exterior longitudinal passage 3*b* and on the outside and in front of the latter (zone 22), referred to as airflow B.

Advantageously, the distribution means comprise one or more solid-particles deflectors 5 which are arranged over the entire periphery of the main pipe 2 to deflect the solid particles of the pulverulent fuel toward the interior longitudinal passage 3*a*, making it possible to create a higher concentration of solid particles in the interior longitudinal passage 3*a* than in the exterior longitudinal passage 3*b*.

Particles heavier than air have a tendency to rebound off the deflector or deflectors 5 and/or to be deflected and diverted toward the interior longitudinal passage on account of their inertia, whereas the primary transport air will have a tendency to be less deflected toward the interior longitudinal passage than the fuel particles, the speed of the flow being chosen to avoid the settling of particles at low speeds and the abrasion of the pipes at high speeds.

Figure 2:
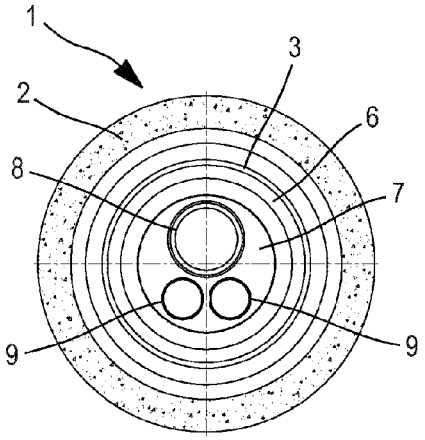
FIG. 2 depicts a front view of a nozzle of the burner.

In the preferred embodiment of the two embodiments a cylindrical interior pipe 6 arranged in and concentric with the interior tube allows a flame stabilizer 7 to be present at the outlet of the nozzle of the burner 1 and fuel conveying pipes, as illustrated in FIG. 2.

As is known from the prior art, the flame stabilizer 7 comprises a circular plate having cooling orifices and through which the fuel conveying pipes pass.

The zone situated in front of the flame stabilizer 7 constitutes a central dead zone which is out of the streams of fuel and inside the arrival or arrivals of primary air leaving the openings, particularly the airflows A and B.

A mixing of the primary transport combustion air and of the fuel sufficient to form a flame occurs outside of this dead central zone.

This flame stabilizer allows better mixing of the airflows A and B and of the fuel, leaving space in the dead zone for the gases to mix.

Of the pipes conveying fuel to the outlet nozzle of the burner 1, one of the pipes 8 or 9 is able to convey what is referred to as a starter fuel so that the burner 1 can be ignited safely, this pipe constituting the igniter of the burner 1, and the other pipes 8 or 9 conveying alternative liquid or solid fuels.

Here, across all the figures, because of the positioning of the interior longitudinal tube 3 with respect to the interior pipe 6, the interior longitudinal passage 3*a* is created between the interior pipe 6 and the interior tube and the exterior longitudinal passage 3*b* is created between the interior tube and the main pipe 2.

The interior longitudinal tube 3 can be moved axially with respect to the interior pipe 6 and with respect to the main pipe 2.

The interior pipe 6 can also be moved axially with respect to the main pipe 2 in an alternative form of embodiment.

Some distance from a primary transport air outlet end 10 it has a geometric shape that allows a narrowing of the cross section of the interior longitudinal passage 3*a*, for example a tapering cylindrical wall 11 which diverges toward the outside, followed here by a straight outlet wall 12 which opens to the outlet end 10.

The outlet wall 12 may be inclined. The outlet wall may for example be the continuation of the divergent tapering cylindrical wall, allowing better progressivity in the regulating of the flow.

The main pipe 2 also has a geometric shape that allows a narrowing of the cross section of the interior longitudinal passage 3*a*, for example in the form of a tapering cylindrical wall 13 which converges toward the inside, followed by a straight outlet wall 14.

The tapering cylindrical wall 13 is situated upstream of the tapering cylindrical wall 11 with respect to the flow.

The outlet wall 14 may be inclined. The outlet wall may, for example, be the continuation of the convergent tapering cylindrical wall, something which allows better progressivity in the regulating of the flow.

Several deflectors 5 are situated axially one after the other and follow in series along the main axis C-C and are arranged in such a way as to deflect the solid particles toward the interior longitudinal passage 3*a*.

In the embodiment illustrated in FIGS. 1, 4*a*, 4*b*, 6 and 7, the deflectors 5 are rings of different sizes, which are fixed in the burner 1 concentrically (having the same center), the smallest-diameter ring being situated downstream of the largest-diameter ring, with respect to the flow of the laden primary transport air in the main pipe 2.

In other words, the rings have diameters that decrease between upstream and downstream of the flow, and longitudinal and/or radial spaces between which the air and some of the solid particles pass are left between the rings.

Another proportion of the particles has a tendency, on account of the weight thereof, to be deflected toward the center of the pipe 2, particularly toward the interior longitudinal passage 3*a* more than toward the periphery of the pipe 2, particularly toward the exterior longitudinal passage 3*b*.

In other words, the spaces left between the rings, and the arrangement of the rings, make it possible to allow more air than solid particles to pass, the solid particles being deflected along the rings and diverted from upstream ring to downstream ring toward the interior longitudinal passage 3*a*.

Thus, depending on these spaces, on the geometry and on the angle at which the rings 5 are set with respect to the longitudinal axis of the burner 1 and to the flow, it is possible to have two solid-particles concentrations of the airflow A and of the airflow B which are similar or further apart.

For example, the choice may be made to distribute between 10% and 40% of solid particles in the airflow A and 60% to 90% of solid particles in the airflow B.

Four rings are illustrated here, but the invention is not restricted to this number.

Figure 3:
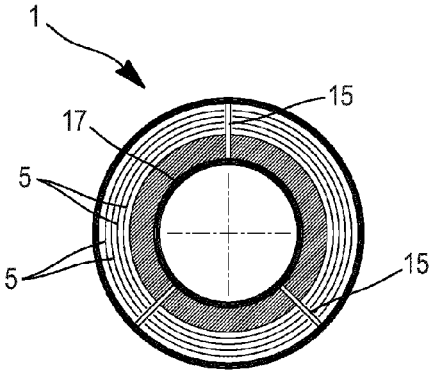
FIG. 3 depicts a view in cross section of deflectors of the burner according to the invention.
Figure 4A:
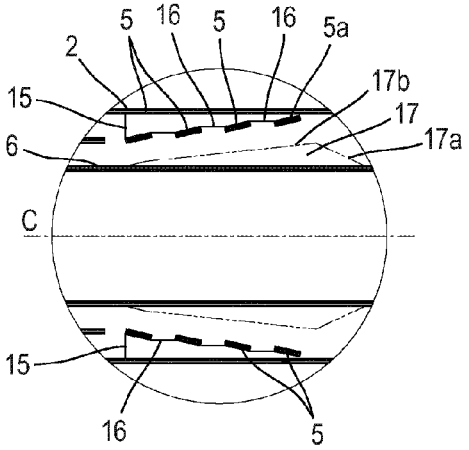
FIGS. 4*a* and 4*b* illustrate a detailed view in longitudinal section of the deflectors of the burner.
Figure 4B:
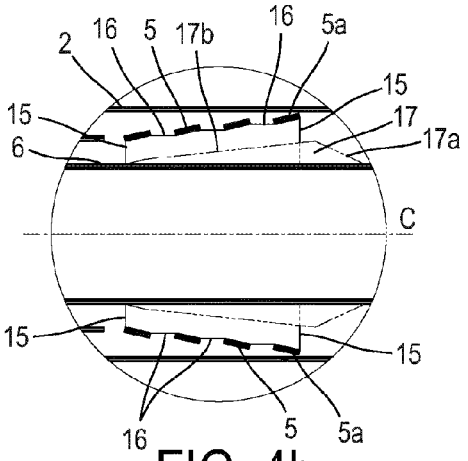
Figure 5A:
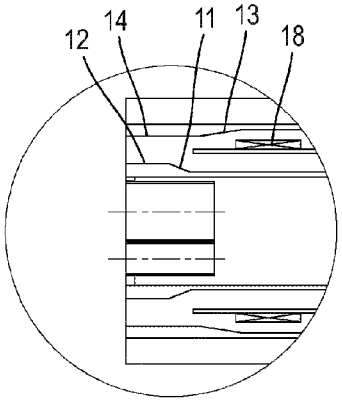
FIGS. 5*a* and 5*b* illustrate a detailed view in longitudinal section of the end of the nozzle of the burner.
Figure 5B:
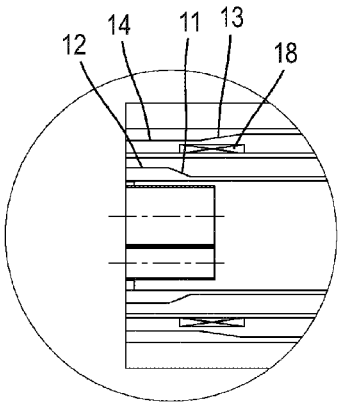

The rings may be fixed by a support means illustrated in FIG. 3 to an interior wall of the main pipe 2, as illustrated in FIG. 4*a*, and/or to an exterior wall of the internal pipe, as illustrated in FIG. 4*b*.

These support means in this instance are radial stays 15 and longitudinal stays 16.

The longitudinal stays 16 join the deflectors 5 together one behind the other along the main pipe 2.

The radial stays 15 fix the deflectors 5, which are joined together by the longitudinal stays 16, for example, at the first deflector 5*a* and at the fourth deflector 5*b*, to the interior pipe 6 and/or the main pipe 2.

The deflectors 5 may also be fixed together on the interior longitudinal tube 3.

In an alternative form of embodiment which has not been depicted, the deflector or deflectors 5 may be fixed individually to the main pipe 2 or to the interior pipe 6 or to the interior longitudinal tube 3.

In the two embodiments of the burner 1 which have been depicted in all the figures, the deflectors 5 are rings with a frustoconical interior longitudinal surface converging toward the interior pipe 6.

By way of purely illustrative example, they may be set at an angle of 5 to 45° with respect to the main axis C-C of the main pipe 2.

They may be set at the same angle with respect to the main axis C-C of the main pipe 2.

In an alternative form of embodiment, the deflectors 5 may be rings with a straight longitudinal exterior surface and a frustoconical interior surface.

The number of deflectors is not limited to four and varies notably according to the speed of the flow, to the distance of the deflector or deflectors 5 with respect to the longitudinal tube 3.

In an alternative form of embodiment, just one frustoconical longitudinal element, possibly perforated, oriented in such a way as to allow solid particles to be deflected toward the interior longitudinal passage 3*a* is conceivable.

A deflector exhibiting symmetry of revolution and fixed to the main pipe 2 at a distance from the longitudinal tube 3 with a converging upstream frustoconical longitudinal surface and a diverging downstream frustoconical longitudinal surface is also possible and allows the particles to be deflected even more toward the interior longitudinal passage than toward the exterior longitudinal passage, while the primary air can reorganize itself between the deflector and the longitudinal tube 3 in order to flow in comparable quantities in the interior longitudinal passage 3*a* and the exterior longitudinal passage 3*b*.

A guide piece 17 for guiding the flow of primary transport air and situated upstream of the deflector or deflectors 5 has a geometric shape that allows the flow to be guided toward the interior wall of the main pipe 2, more specifically toward the inlet deflector 5*a*, then toward the inside of the main pipe 2, more specifically toward the other deflectors 5 so as to guide the flow of the transport air toward the interior longitudinal passage 3*a*.

For example, in longitudinal section it has a divergent upstream frustoconical longitudinal surface and a convergent downstream frustoconical longitudinal surface.

The divergent frustoconical longitudinal surface guides the flow of primary transport air toward the inlet deflector 5*a*.

The convergent frustoconical longitudinal surface guides the flow of primary transport air toward the other deflectors 5 and the interior longitudinal passage 3*a*.

This guide piece 17 can be moved axially using means known from the prior art.

Advantageously, a means 18 for inducing swirl in the primary transport air is arranged fixed to the interior tube, in the exterior longitudinal passage 3*b*, near the primary transport air outlet end nozzle.

This swirl-inducing means 18 allows swirl to be induced in the air circulating around the main axis C of the burner 1, in the exterior longitudinal passage 3*b*.

The airflow B with a lesser concentration of solid particles in this exterior longitudinal passage 3*b* ignites more quickly on contact with the oxygen of the secondary exterior air that surrounds it, making it possible to have what is referred to as an oxidizing first zone in which the fines are rapidly ignited.

The airflow A which is more concentrated in solid particles leaving the interior longitudinal passage 3*a* surrounded by the ignited airflow B ignites more easily in its turn, and this creates a NOx-reduction second zone.

The centered part of the airflow A is even further away from the secondary air, thereby creating a stable zone concentrated in fuel and generating carbon-containing radicals HCN in a third zone.

The swirl-inducing means 18 is, in the figures here, fixed to the interior longitudinal tube 3.

It can therefore be moved axially with the movement of the interior tube 3. The movement of this swirl-inducing means 18 via the movement of the tube 3 allows the proportion of the flow rates of air transporting the pulverulent fuel respectively entering the pipes 3*a* and 3*b* to be varied. Because the flow rate of air circulating along the pipe 3*b*, and therefore through the swirl-inducing means 18, can thus be adjusted, it is possible to modify the shape of the flame by inducing swirl in a greater or lesser amount of air, thus best adjusting the shape of the flame to suit the needs of the process.

The swirl-inducing means 18 has vanes or baffles, which may or may not be inclined with respect to the radius of the main pipe 2 and have not been depicted here.

The interior pipe 6 comprises, at the primary transport air outlet end, a frustoconical exterior shape which, as only the tube 3 is being moved, allows the cross section of the interior longitudinal passage 3*a* to be altered. This changing cross section generates a pressure drop equivalent to that generated by the movement of the vanes of the swirl-inducing means 18 in the cross section of the exterior longitudinal passage 3*b*. This feature allows the flow rate passing between the vanes 18 and therefore the quantity of air made to swirl and therefore the shape of the flame to be varied without varying the proportion of flow rate circulating along the interior and exterior longitudinal passages 3*a*, 3*b*.

In other words, moving the tube 3 alone allows the flow rate passing between the vanes 18 to be varied without changing the proportion of flow rate circulating along the interior and exterior longitudinal passages 3*a*, 3*b*, the flow rate of air circulating along the entire exterior longitudinal passage remaining the same.

In other words, the geometric outlet shape of the interior pipe 6 at the nozzle allows the pressure drops in the interior longitudinal passage 3*a* to be increased in order to compensate for the pressure drops in the exterior longitudinal passage 3*b* which are caused by the presence of the swirl-inducing means 18.

When the interior tube 3 to which the swirl-inducing means 18 is fixed is in a forward position with respect to the axis C-C, the pressure drops are compensated for.

The swirl-inducing means 18 is situated in the region of the tapering cylindrical wall 13 when the interior tube 3 is in the forward position.

The flow of the primary transport air with a lower concentration of pulverulent fuel particles passes through the swirl-inducing means 18 and the geometric shape of the interior pipe 6 is inside the end of the tube, allowing the airflow to be deflected into the interior longitudinal passage 3*a* in order to create pressure drops equivalent to those created in the airflow in the swirl-inducing means 18.

In other words, the frustoconical shape 11 reduces the cross section of the longitudinal passage 3 which is closed on one side by the longitudinal tube 3 and which is closed on the other side by the interior pipe 6 when the longitudinal tube 3 is in the forward position.

When the interior tube to which the swirl-inducing means 18 is fixed is in the retracted position with respect to the axis C-C, the flow of primary transport air with a lower concentration of pulverulent fuel particles avoids the swirl-inducing means 18 and the geometric shape of the interior pipe 6 is outside the end of the tube, allowing the airflow in the interior longitudinal passage 3*a* to be deflected toward the exterior longitudinal passage 3*b*, thereby limiting the pressure drops which are once again equivalent to those created at the airflow of the exterior longitudinal passage 3*b* that is avoiding the swirl-inducing means 18.

In other words, the frustoconical shape 11 hardly, if at all, reduces the cross section of the longitudinal passage 3*a* which is open on one side at the end of the longitudinal tube 3 situated upstream of the frustoconical shape 11 with respect to the flow, and which is closed on the other side by the interior pipe 6 when the longitudinal tube 3 is in the retracted position.

As an alternative form of embodiment which has not been depicted, the mobility of the longitudinal tube 3 to which the swirl-inducing means 18 is fixed and the arrangement of the pipes 3 and 6 allow the proportion of air circulating through the exterior longitudinal passage 3*b* and through the interior longitudinal passage 3*a* to be regulated. In other words, it is also possible to cause the flow rate of air to vary between the exterior longitudinal passage 3*b* and the interior longitudinal passage 3*a* by moving the interior tube 3 and the interior pipe 6 with respect to the main pipe 2.

As illustrated in FIG. 6, what is referred to as the "indirect-fired" burner 1 has at least one concentric cylindrical pipe 19 on the outside of the main pipe 2.

A straight (or axial) longitudinal flow of primary air and/or a swirling (peripheral or radial) longitudinal flow of air circulates or circulate in this exterior pipe.

In addition, an axial primary air flow and/or a swirling longitudinal air flow circulate or circulates in the internal pipe.

As illustrated in FIG. 7, the indirect-fired burner 1 has at least two cylindrical pipes 20 and 21 which are on the outside of and concentric with the main pipe 2.

A longitudinal primary air flow made to swirl by a swirl-inducing means circulates along the first exterior pipe 20.

A straight longitudinal primary air flow circulates along the second exterior pipe 21.

In addition, a straight longitudinal primary air flow circulates along the interior pipe 6.

For both embodiments of a "direct-fired" burner 1 and an "indirect-fired" burner 1, the pulverulent fuel particles are deflected toward the interior longitudinal passage 3*a*.

Which makes it possible to create an exterior primary airflow less concentrated in pulverulent fuel which will surround the interior primary airflow.

This exterior primary airflow less concentrated in pulverulent fuel will burn more quickly and in turn allow the interior primary airflow which is more concentrated in pulverulent fuel to burn.

Thus, the staged ignition makes it possible to achieve more rapid combustion with the secondary air, to produce more reducing species (HCN, NH3, HC, etc.) by heating the pulverulent fuel before burning it, thereby reducing the formation of oxides of nitrogen.

The system for adjusting the flow rates of air between the interior and exterior longitudinal passages 3*a* and 3*b* and for inducing swirl in the exterior longitudinal passage 3*b* at the outlet 10 from the burner itself allows the shape of the flame to be adjusted.

The invention claimed is:

1. A burner comprising a longitudinal main pipe into the inlet of which primary transport air laden with solid particles of a pulverulent fuel circulates;

a longitudinal tube arranged inside and concentric with the longitudinal main pipe, extending next to an outlet end at which the primary transport air leaves the longitudinal main pipe, and creating an exterior longitudinal passage arranged around and concentric with an interior longitudinal passage;

upstream of the longitudinal tube, at least one solid-particles deflector arranged on the periphery of the longitudinal main pipe to deflect the solid particles in such a way as to create a higher solid-particles concentration in the primary transport air in the interior longitudinal passage than in the exterior longitudinal passage;

an interior pipe comprising a flame stabilizer, with the interior pipe being arranged in and concentric with the longitudinal tube, the interior longitudinal passage being created between the interior pipe and the interior tube, and the exterior longitudinal passage being created between the longitudinal tube and the longitudinal main pipe, at least one baffle arranged in the exterior longitudinal passage so as to induce swirl at the burner outlet in the primary transport air that has a lower solid-particles concentration, wherein the at least one solid-particles deflector comprises longitudinally and radially spaced-apart rings, following on, in series, along a main axis of the longitudinal main pipe, having a diameter size that decreases from upstream to downstream with respect to the flow, with the rings being fixed in the burner concentrically, with a smallest diameter ring being situated downstream of a largest diameter ring with respect to a flow of the primary transport air in the longitudinal main pipe and wherein the rings are fixed to an interior wall of the longitudinal main pipe, and/or to an exterior wall of the interior pipe by radial stays and longitudinal stays, with the longitudinal stays joining the at least one solid-particles deflectors together one behind the other along the longitudinal main pipe.

2. The burner of claim 1, wherein the at least one baffle is fixed to the longitudinal tube and can be moved axially with respect to the longitudinal main pipe and to the interior pipe, the longitudinal main pipe has a narrowing of cross section at the outlet of the burner in the exterior longitudinal passage, the flow of the primary transport air with a lower concentration of pulverulent fuel particles entering the baffle when the longitudinal tube is in a forward position and avoiding the baffle when the longitudinal tube is in a retracted position.

3. The burner of claim 1, wherein the at least one solid-particles deflector is situated one after the other in the longitudinal main pipe along the longitudinal axis of the longitudinal main pipe.

4. The burner of claim 1, wherein the rings have a frustoconical interior surface converging toward the interior pipe.

5. The burner of claim 4, wherein the rings are set at an angle of 5 to 45° with respect to the main axis of the longitudinal main pipe.

6. The burner of claim 5, wherein each ring is set at the same angle with respect to the main axis of the longitudinal main pipe.

7. The burner of claim 1, wherein the interior pipe comprises, near the primary transport air outlet end, a frustoconical exterior shape that reduces the cross section of the interior longitudinal passage.

8. The burner of claim 7, wherein the longitudinal main pipe at its burner outlet end comprises a tapering cylindrical wall that converges toward the inside, followed by a straight outlet wall.

9. The burner of claim 1, further comprising at least one pipeline on an outside of and concentric with the longitudinal main pipe and in which an axial flow of primary air circulates.

10. The burner of claim 1, further comprising a first pipeline on an outside of and concentric with the longitudinal main pipe which comprises a baffle to induce swirl in the primary air, and a second pipeline on an outside of and concentric with an exterior of the first pipeline.

11. A burner comprising a longitudinal main pipe into the inlet of which primary transport air laden with solid particles of a pulverulent fuel circulates;

a longitudinal tube arranged inside and concentric with the longitudinal main pipe, extending next to an outlet end at which the primary transport air leaves the longitudinal main pipe, and creating an exterior longitudinal passage arranged around and concentric with an interior longitudinal passage;

upstream of the longitudinal tube, at least one solid-particles deflector arranged on the periphery of the longitudinal main pipe to deflect the solid particles in such a way as to create a higher solid-particles concentration in the primary transport air in the interior longitudinal passage than in the exterior longitudinal passage;

an interior pipe comprising a flame stabilizer, with the interior pipe being arranged in and concentric with the interior longitudinal tube, the interior longitudinal passage being created between the interior pipe and the interior tube, and the exterior longitudinal passage being created between the interior longitudinal tube and the longitudinal main pipe, at least one baffle arranged in the exterior longitudinal passage so as to induce swirl at the burner outlet in the primary transport air that has a lower solid-particles concentration, further comprising a mobile guide piece configured to guide the flow of primary transport air toward the interior longitudinal passage, wherein the guide piece comprises a divergent frustoconical longitudinal surface that guides the flow of primary transport air toward an inlet deflector and a convergent frustoconical longitudinal surface that guides the flow of primary transport air toward the other deflectors and the interior longitudinal passage and the frustoconical exterior shape of the interior pipe is situated inside the longitudinal main pipe so that a pressure drop in the interior and exterior longitudinal passages, when the longitudinal tube is in a forward position for which the flow of the primary air passes into the swirl-inducing means, are equal to a pressure drop in the interior and exterior longitudinal passages when the longitudinal tube is in a retracted position in which the flow of the primary air avoids the swirl-inducing means.

12. The burner of claim 11, wherein the interior pipe comprises, near the primary transport air outlet end, a frustoconical exterior shape that reduces the cross section of the interior longitudinal passage.

13. The burner of claim 12, wherein the longitudinal main pipe at its burner outlet end comprises a tapering cylindrical wall that converges toward the inside, followed by a straight outlet wall.

14. The burner of claim 11, further comprising at least one pipeline on an outside of and concentric with the longitudinal main pipe and in which an axial flow of primary air circulates.

15. The burner of claim 11, further comprising a first pipeline on an outside of and concentric with the longitudinal main pipe which comprises a baffle to induce swirl in the primary air, and a second pipeline on an outside of and concentric with an exterior of the first pipeline.

* * * * *